US010598315B2

(12) United States Patent
Wen et al.

(10) Patent No.: US 10,598,315 B2
(45) Date of Patent: Mar. 24, 2020

(54) LIGHTING DEVICE AND METHOD OF ASSEMBLING A LIGHTING DEVICE

(71) Applicant: LEDVANCE GmbH, Garching bei Munchen (DE)

(72) Inventors: Haitao Wen, Shenzhen (CN); Jun Liu, Guangdong (CN); Ran Lin, Shenzhen (CN); HongWei Zhang, Guangdong (CN)

(73) Assignee: LEDVANCE GMBH, Garching bei Munich (DE)

( * ) Notice: Subject to any disclaimer, the term of this patent is extended or adjusted under 35 U.S.C. 154(b) by 0 days.

(21) Appl. No.: 16/073,099

(22) PCT Filed: Jan. 26, 2017

(86) PCT No.: PCT/EP2017/051599
§ 371 (c)(1),
(2) Date: Jul. 26, 2018

(87) PCT Pub. No.: WO2017/129651
PCT Pub. Date: Aug. 3, 2017

(65) Prior Publication Data

US 2019/0032860 A1 Jan. 31, 2019

(30) Foreign Application Priority Data

Jan. 26, 2016 (CN) ..... 2016 1 0053338

(51) Int. Cl.
*F21K 9/232* (2016.01)
*F21V 19/00* (2006.01)
(Continued)

(52) U.S. Cl.
CPC ..... *F21K 9/232* (2016.08); *F21V 19/005* (2013.01); *F21V 29/50* (2015.01); *F21V 29/74* (2015.01);
(Continued)

(58) Field of Classification Search
CPC ..... F21K 9/232; F21V 19/005; F21V 29/74; F21V 29/50; F21V 3/02; F21Y 2115/10; F21Y 2107/30; F21Y 2107/00
See application file for complete search history.

(56) References Cited

U.S. PATENT DOCUMENTS

2011/0163683 A1* 7/2011 Steele ..... F21V 23/02 315/192
2012/0140517 A1* 6/2012 Sakamoto ..... G02B 6/0036 362/607
(Continued)

FOREIGN PATENT DOCUMENTS

CN 101793362 A 8/2010
JP 2015079744 A 4/2015
JP 2015079744 A * 4/2015 ..... F21S 2/00

*Primary Examiner* — Donald L Raleigh
(74) *Attorney, Agent, or Firm* — Hayes Soloway PC

(57) ABSTRACT

A lighting device is provided, which includes a first lighting unit, a heat-dissipating unit heat-conductively connected to the first lighting unit; a second lighting unit, a second heat-dissipating unit heat-conductively connected to the second lighting unit; and a driver electrically connected with the first lighting unit and the second lighting unit. Furthermore, a method of assembling a lighting device is provided.

24 Claims, 7 Drawing Sheets

(51) Int. Cl.

| | |
|---|---|
| ***F21V 29/74*** | (2015.01) |
| ***F21V 29/50*** | (2015.01) |
| *F21Y 107/30* | (2016.01) |
| *F21Y 107/00* | (2016.01) |
| *F21Y 115/10* | (2016.01) |
| *F21V 3/02* | (2006.01) |

(52) U.S. Cl.
CPC ..... *F21V 3/02* (2013.01); *F21Y 2107/00* (2016.08); *F21Y 2107/30* (2016.08); *F21Y 2115/10* (2016.08)

(56) References Cited

U.S. PATENT DOCUMENTS

2012/0257374 A1* 10/2012 Daniel ..... F21K 9/90 362/84
2012/0293057 A1* 11/2012 Yamamoto ..... F21V 29/004 313/45
2012/0320594 A1* 12/2012 Chien ..... F21V 21/14 362/249.03
2013/0010463 A1 1/2013 Li et al.
2013/0020462 A1* 1/2013 Kim ..... F21V 19/003 250/205
2014/0340899 A1* 11/2014 Bailey ..... F21V 23/006 362/245
2015/0092404 A1* 4/2015 Kim ..... F21V 19/045 362/227
2015/0300623 A1* 10/2015 Kim ..... F21V 27/02 362/249.02
2016/0061424 A1* 3/2016 Hatanaka ..... F21V 19/005 362/382
2018/0010784 A1* 1/2018 Kim ..... F21V 29/70

* cited by examiner

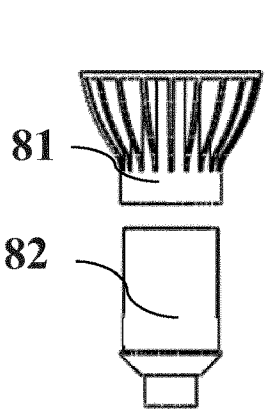
Fig. 7
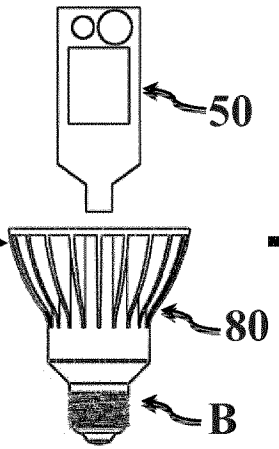
Fig. 8
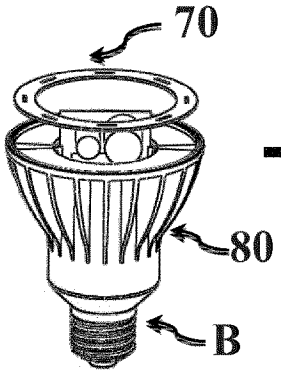
Fig. 9
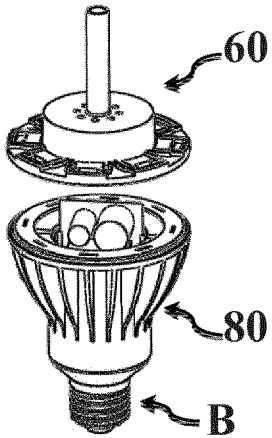
Fig. 10
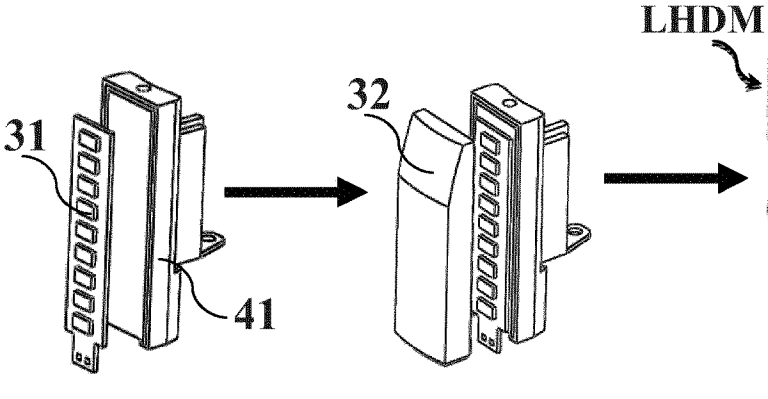
Fig. 11
Fig. 12
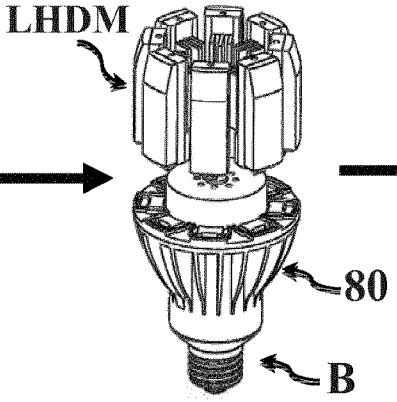
Fig. 13
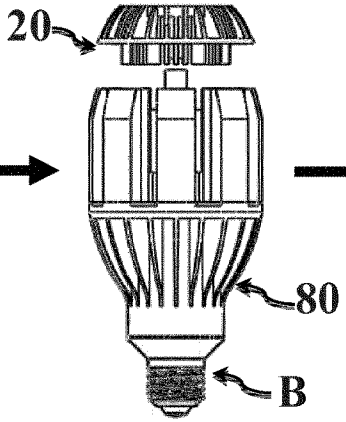
Fig. 14
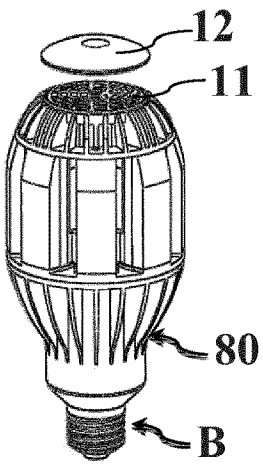
Fig. 15

LIGHTING DEVICE AND METHOD OF ASSEMBLING A LIGHTING DEVICE

CROSS-REFERENCE TO RELATED APPLICATIONS

This application is a U.S. National phase entry under 35 U.S.C. § 371 of International Application No. PCT/EP2017/051599, filed on Jan. 26, 2017, which claims priority to Chinese Patent Application 201610053338.2, filed on Jan. 26, 2016. Each of these patent applications is incorporated by reference herein in its entirety.

FIELD OF THE INVENTION

This application relates to a lighting device and a method of assembling a lighting device.

BACKGROUND OF THE INVENTION

The contents of this section merely provide background information related to the present disclosure and may not constitute the prior art.

LED technology has advantages such as high efficiency, energy saving and long service life, and thus lighting systems using LED modules as light sources have been widely applied in lighting technology. In an LED lighting system, heat-dissipating performance is very important, because heat dissipation may directly affect normal operation of the LED lighting system, especially may directly affect the performance and lifetime of an LED module in the lighting system. Therefore, in the conventional technology, heat-dissipating devices of a variety of materials and shapes are employed, and these heat-dissipating devices are configured to especially dissipate heat of the LED light engine. In some applications, such as projection illumination applications, a lighting device with a higher luminous flux, such as thousands of lumens (lm), for example an LED light with high lumens, is required, such lighting device with the higher luminous flux may correspondingly generate considerable amount of heat, and such considerable amount of heat may further deteriorate the performance of the LED light and reduce the lifetime of the LED light.

Therefore, there is a need in the prior art for improving heat dissipation of a lighting device.

SUMMARY OF THE INVENTION

One object of the present application is to provide a lighting device with improved heat dissipating performance.

Another object of the present application is to provide a lighting device in which sealing effect of an LED light engine is improved.

For achieving one or more of the above objects, according to one aspect of the present application, a lighting device is provided, which includes a first lighting device, a first heat-dissipating unit heat-conductively connected to the first lighting device, a second lighting device, a second heat-dissipating unit heat-conductively connected to the second lighting unit; and a driver electrically connected with the first lighting unit and the second lighting unit.

In the lighting device of present embodiment, a higher luminous flux is provided by the two lighting units, thus providing greater illumination intensity. Furthermore, by respectively providing the two lighting units with the heat-dissipating units, the heat dissipation effect is considerably improved, thus improving the performance and lifetime of the lighting device.

In the present application, by employing a positive fit, particularly the convex-concave mating structure, at a part of or all of connections between the components of the lighting device and in conjunction with the water-proof glue, the sealing effect of the lighting device, particularly of the LED light engine, is considerably improved, for example a water-proofing and rust-preventing level of IP 65 can be achieved.

According to another aspect of the present application, a method of assembling a lighting device is provided, which includes providing a housing; providing a driver and inserting the driver into the housing; providing an annular printed circuit board and mounting the printed circuit board to the housing; providing a retainer and mounting the retainer to the printed circuit board and the housing in a positive fit manner; providing a plurality of side lighting and heat-dissipating modules and assembling, in a positive fit manner, the plurality of side lighting and heat-dissipating modules to the retainer which has been mounted to the printed circuit board and the housing; providing a first heat-dissipating unit and assembling the first heat-dissipating unit to the plurality of side lighting and heat-dissipating modules; and providing first lighting unit and mounting the first lighting unit to the first heat-dissipating unit in a positive fit manner.

By providing the separated side lighting and heat-dissipating module, for example by assembling in advance the side light-transmitting cover, the side LED light engine and the side heat dissipator into a module and then assembling the module to the retainer, the filling of the connecting parts with glue can be made without rotating the whole light, and degree of automation in assembling or manufacturing process can be considerably improved, thus considerably enhancing the productivity efficiency.

BRIEF DESCRIPTION OF THE DRAWINGS

Features and advantages of embodiments of the present application can be understood more readily with reference to the description in conjunction with the drawings, and in the drawings:

FIGS. 7-15 are schematic views showing an assembling process of a lighting device according to an embodiment of the present application.

DETAILED DESCRIPTION OF THE INVENTION

The following descriptions of preferred embodiments are merely exemplary, and are no way intended to limit the present disclosure and application or use thereof. Like reference numbers in the various drawings indicate like components, and thus the constructions of the like components will not be repeated.

Next, a general construction of a lighting device of the present application is described with reference to FIGS. 1 to 6.

Figure 1:
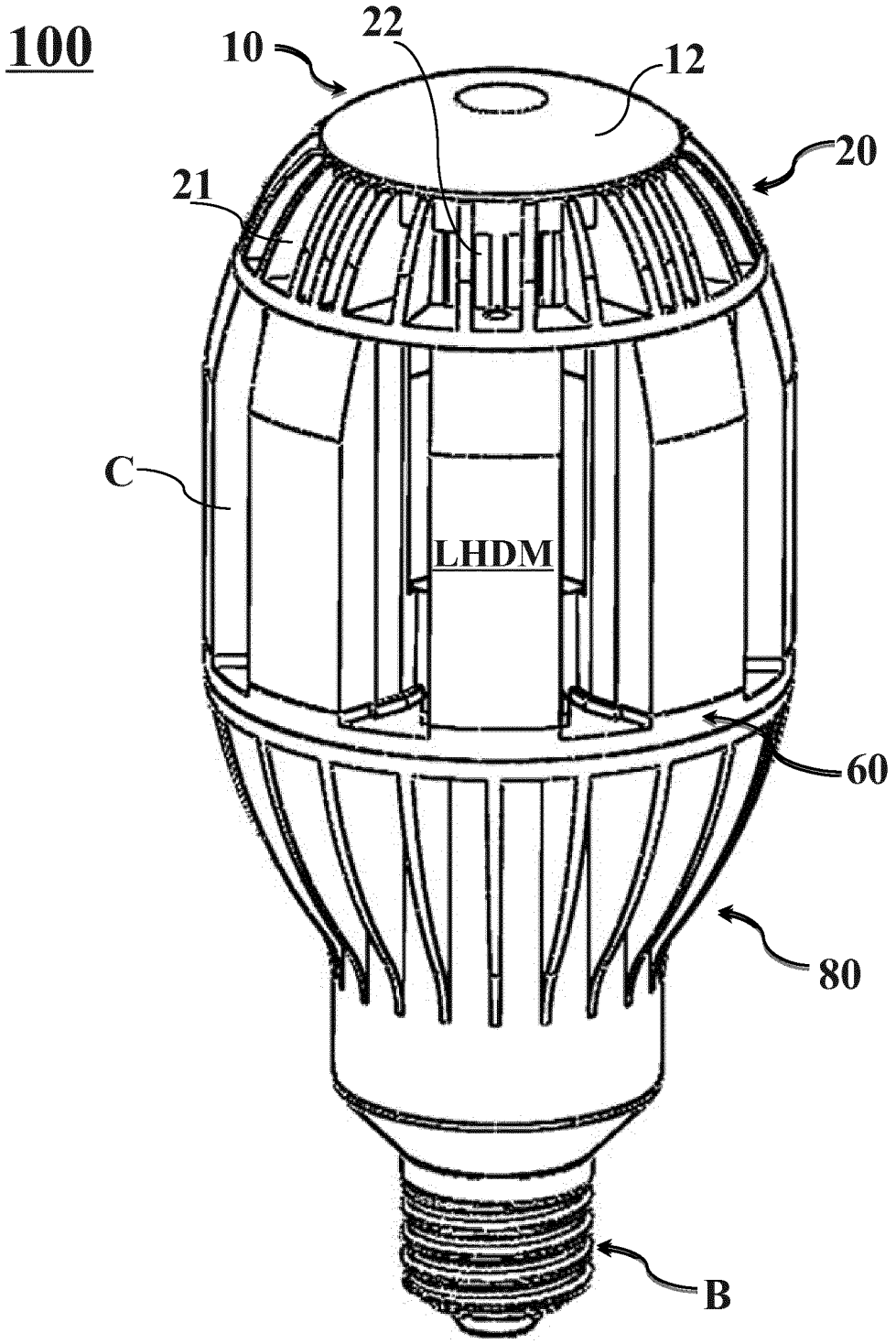
FIG. 1 is a perspective view of a lighting device according to an embodiment of the present application.
Figure 2:
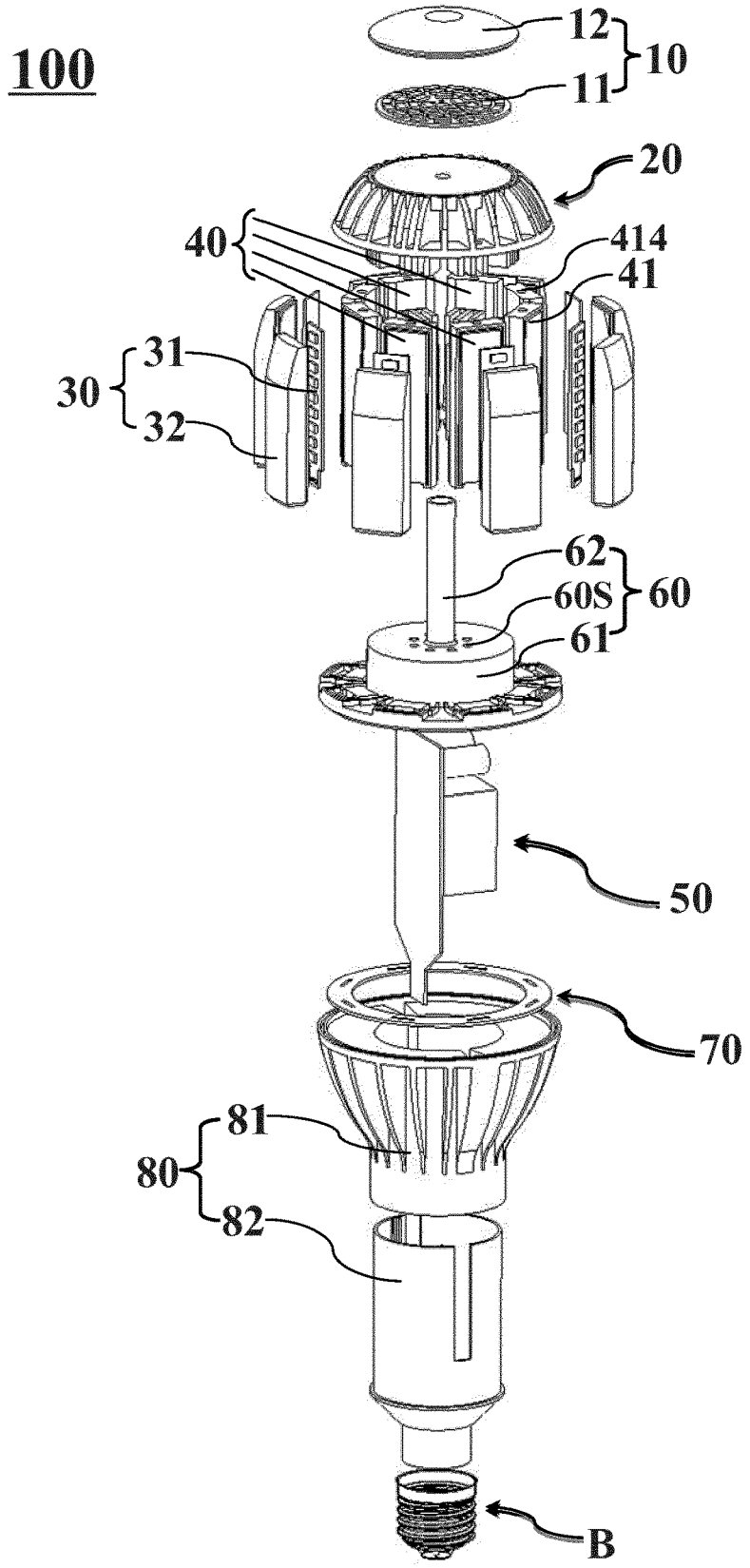
FIG. 2 is an exploded perspective view of the lighting device in FIG. 1.

Firstly, as shown in FIGS. 1 and 2, a lighting device 100 includes a first lighting unit 10, a first heat-dissipating unit 20, a second lighting unit 30, a second heat-dissipating unit 40 and a driver 50. The first heat-dissipating unit 20 is heat-conductively connected to the first lighting unit 10. The second heat-dissipating unit 40 is heat-conductively connected to the second lighting unit 30. The driver 50 is electrically connected with the first lighting unit 10 and the second lighting unit 30 to supply power to the first lighting unit 10 and the second lighting unit 30 and drive the first lighting unit 10 and the second lighting unit 30 to emit light.

In the lighting device of present embodiment, a higher luminous flux is provided by the two lighting units, thus providing greater illumination intensity. Also, by respectively providing the two lighting units with heat-dissipating units, the effect of heat dissipation is considerably improved, thereby considerably improve the performance and lifetime of the lighting device.

Particularly, as shown in FIG. 2, the first lighting unit 10 includes a top LED light engine 11, the second lighting unit 30 includes a plurality of, preferably eight, side LED light engines 31, and the second heat-dissipating unit 40 is detachably connected to the first heat-dissipating unit 20 (for example, by means of screws or bolts) and includes a plurality of, preferably eight, side heat dissipators 41 corresponding to the plurality of side LED light engines 41. The first heat-dissipating unit 20 has a truncated dome shape or a truncated cone shape, and as shown in FIG. 1, the first heat-dissipating unit 20 includes a plurality of heat-dissipating fins 21 distributed on an outer circumferential surface of the first heat-dissipating unit 20. The first heat-dissipating unit 20 is provided with at least one through holes 22, each of which being located in a circumferential wall between two adjacent heat-dissipating fins 21 of the plurality of heat-dissipating fins 21. By providing such through hole(s) in the circumferential wall of the first heat-dissipating unit 20, a heat-dissipating area of the first heat-dissipating unit 20 contacting with air is greatly increased and the air flowing through the first heat-dissipating unit is promoted, thereby further improving the heat dissipating effect of the first lighting device 10 provided by the first heat-dissipating unit 20.

Figure 3:
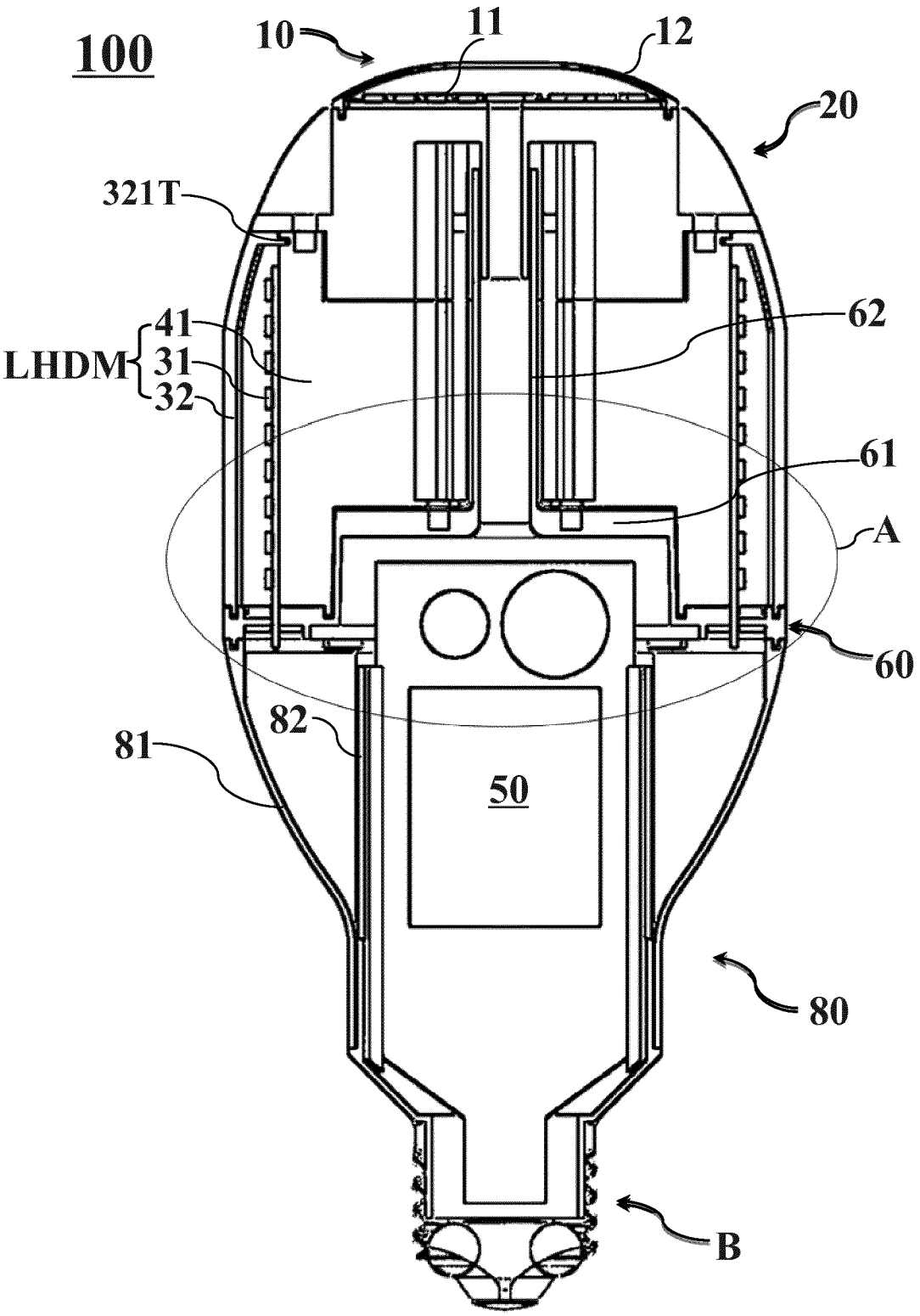
FIG. 3 is a sectional view of the lighting device in FIG. 1.
Figure 4:
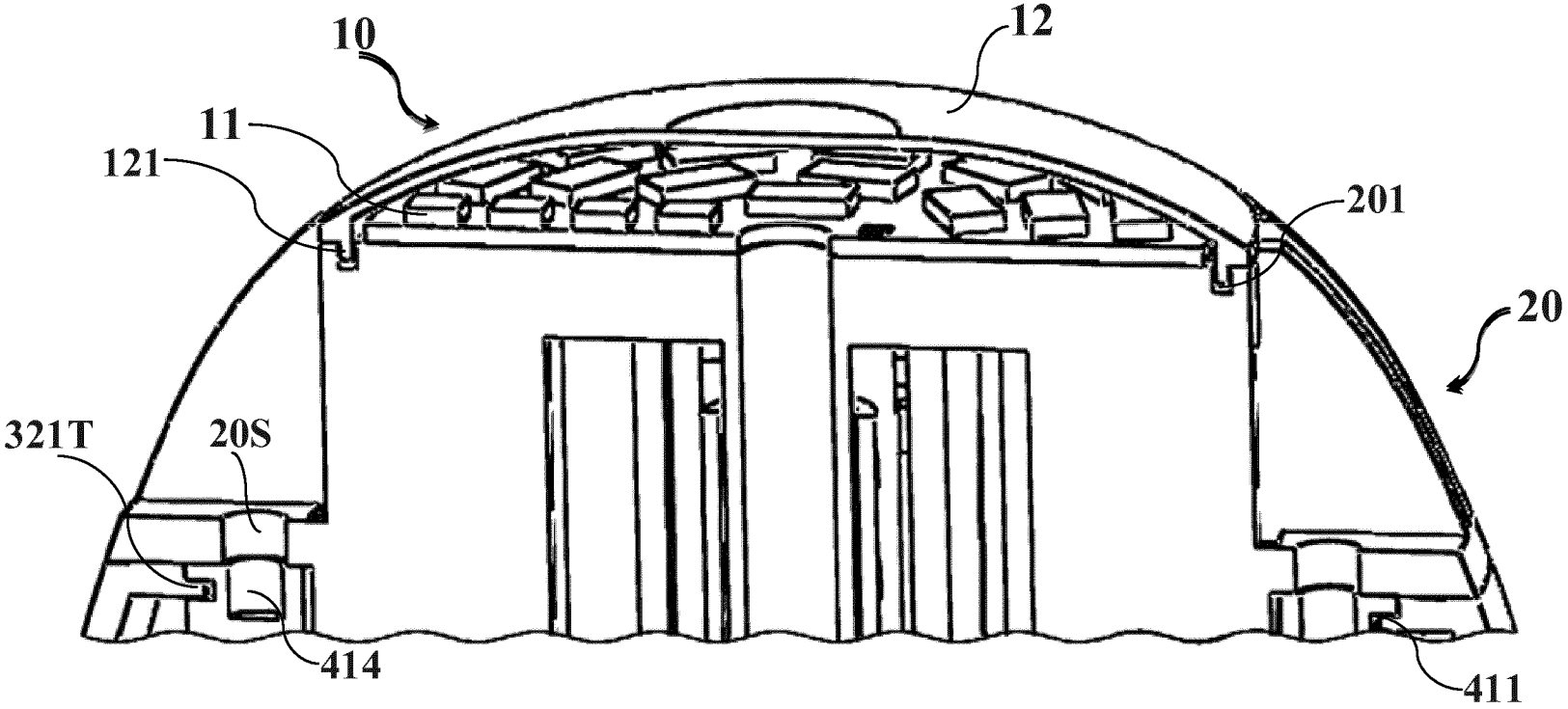
FIG. 4 is a partial sectional perspective view of the lighting device in FIG. 1, showing a top LED light engine, a top light-transmitting cover, a top heat dissipator, a part of a side light-transmitting cover, and a part of a side heat dissipator.

Particularly, as shown in FIGS. 3 and 4, the first lighting unit 10 further includes a top light-transmitting cover 12. The top light-transmitting cover 12 for example is a dome-shaped lens, and the bottom of the top light-transmitting cover 12 is sealingly connected to the top of the first heat-dissipating unit 20 in a positive fit manner, thereby forming a substantially closed sealed space between the top light-transmitting cover 12 and the top of the first heat-dissipating unit 20 and sealingly retaining the top LED light engine 11 within the space between the top light-transmitting cover 12 and the first heat-dissipating unit 20. With such arrangement, the top LED light engine 11 can be effectively sealingly retained within the top light-transmitting cover 12, thus preventing moisture or other foreign matters from entering the first lighting unit 10.

Specifically, as shown in FIG. 4, the bottom (for example, the bottom periphery) of the top light-transmitting cover 12 has a convex portion, for example an annular convex portion 121, and the top (for example, the top periphery) of the first heat-dissipating unit 20 has a matched concave portion, for example an annular concave portion 201, or the bottom (for example, the bottom periphery) of the top light-transmitting cover 12 has a concave portion, for example an annular concave portion, and the top (for example, the top periphery) of the first heat-dissipating unit 20 has a matched convex portion, for example an annular convex portion (not shown). With such convex-concave mating structure, a better sealing can be achieved with a simple structure.

Furthermore, a water-proof glue may be filled in the matched concave portion 201 in the top of the first heat-dissipating unit 20, and the convex portion 121 in the bottom of the top light-transmitting cover 12 partly presses the water-proof glue while being inserted into the matched concave portion 201 in the top of the first heat-dissipating unit 20 so as to fill all of gaps between the convex portion 121 and the concave portion 201 with the water-proof glue, thereby obtaining a better sealing of the top LED light engine 11. Moreover, the convex portion 121 may have a height and a thickness which are respectively slightly smaller than a depth and a width of the concave portion 201, and thus the gap between the convex portion 121 and the concave portion 201 can be sufficiently filled with the water-proof glue so to obtain a batter sealing effect, for example a waterproofing and rust-preventing level of IP 65 can be achieved.

Furthermore, as shown in FIG. 2, the second lighting unit 30 further includes a plurality of, preferably eight, side light-transmitting covers 32 (for example, lens) corresponding to the plurality of side LED light engines 31 and the plurality of side heat dissipators 41. The plurality of side LED light engines 31, the plurality of side heat dissipators 41 and the corresponding plurality of side light-transmitting covers 32 together constitute a plurality of, preferably eight, side lighting and heat-dissipating modules LHDM, where each of the side lighting and heat-dissipating modules LHDM consists of one of the plurality of side LED light engines 31, a respective one of the plurality of side heat dissipators 41 and a respective one of the plurality of side light-transmitting covers 32. By providing the side lighting and heat-dissipating module, the filling of the connecting parts with the glue can be made without rotating a whole light, thus considerably improving degree of automation in assembling or manufacturing process and considerably enhancing the production efficiency.

Particularly, as shown in FIG. 1, the plurality of side lighting and heat-dissipating modules LHDM are spaced from each other in a circumferential direction (that is a direction in which the plurality of side lighting and heat-dissipating modules LHDM are arranged), for example are spaced from each other by gap C. By providing such gap between the plurality of side lighting and heat-dissipating modules LHDM, a heat-dissipating area of the side heat dissipator 41 contacting with air is considerably increased and the air flowing through the side heat dissipator is promoted, thus further improving the heat dissipation effect of the plurality of side lighting and heat-dissipating modules LHDM, that is, improving the heat dissipation effect of the second lighting unit 30.

Additionally, radially inner portions of the plurality of side light-transmitting covers 32 are sealingly connected to radially outer portions of the plurality of side heat dissipators in a positive fit manner, respectively, thereby forming a substantially closed sealing space between the side light-transmitting cover 32 and the side heat dissipator 41. Particularly, for each side lighting and heat-dissipating module LHDM, the radially inner portion of the side light-transmitting cover 32 is sealingly connected, at the top and the both sides, to the radially outer portions of the plurality of side heat disspators 41 in a positive fit manner.

Figure 5:
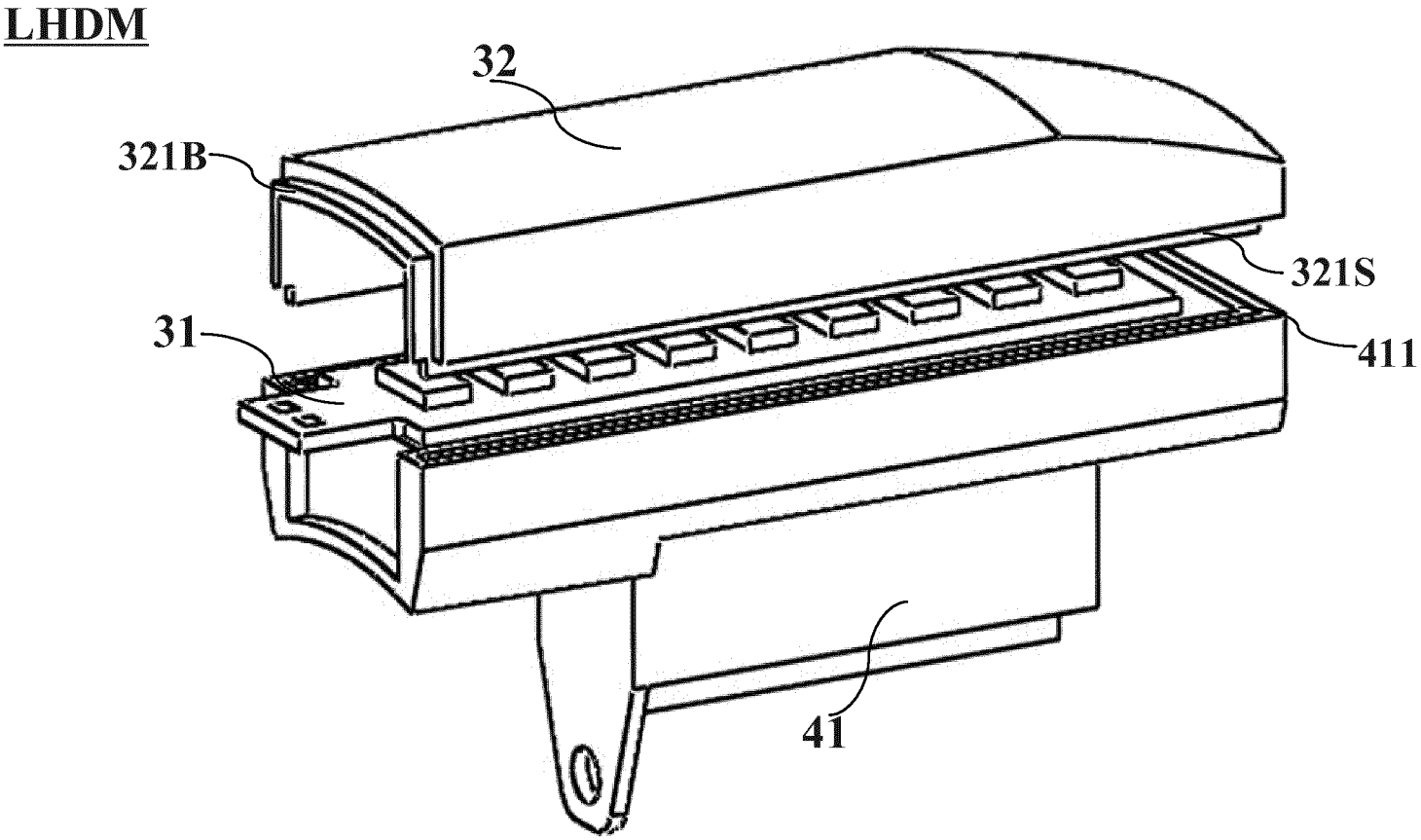
FIG. 5 is an exploded perspective view of a lighting and heat-dissipating module of the lighting device in FIG. 2, showing a side LED light engine, a side light-transmitting cover and a side heat dissipator.

Specifically, as shown in FIGS. 4 and 5, the radially inner portions of the plurality of side light-transmitting covers 32 each has convex portions 321S (although only one convex portion 321S is shown in FIG. 5, a convex portion is also provided on the other side of the side light-transmitting cover 32), a convex portion 321T (as shown in FIG. 4), and the radially outer portions of the plurality of side heat dissipators 41 each has a matched concave portion 411. Or, the radially inner portions of the plurality of side light-transmitting covers 32 each has a concave portion and the radially outer portions of the plurality of side heat dissipators 41 each has a matched convex portion (not shown). Similarly, a water-proof glue also can be filled in the matched concave portions 411 of the radially outer portions of the plurality of side heat dissipators 41. Furthermore, the convex portions 321S, 321T may have a height and a thickness which are respectively slightly smaller than a depth and a width of the concave portion 411, and thus a gap between the concave portion 411 and the convex portions 321S, 321T can be sufficiently filled with the water-proof glue, thereby obtaining a better sealing effect.

Moreover, as shown in FIGS. 2 and 3, the lighting device 100 further includes a retainer (also referred to as a lid) 60 and a housing 80 bearing the driver 50, with the retainer 60 being interposed between the housing 80 and the plurality of side lighting and heat-dissipating modules LHDM. Particularly, the housing 80 may include a first housing 81 having a bowl-like shape, and a second housing 82 having a cylindrical shape, and a space within the housing 80 is configured to bear the driver 50.

Figure 6:
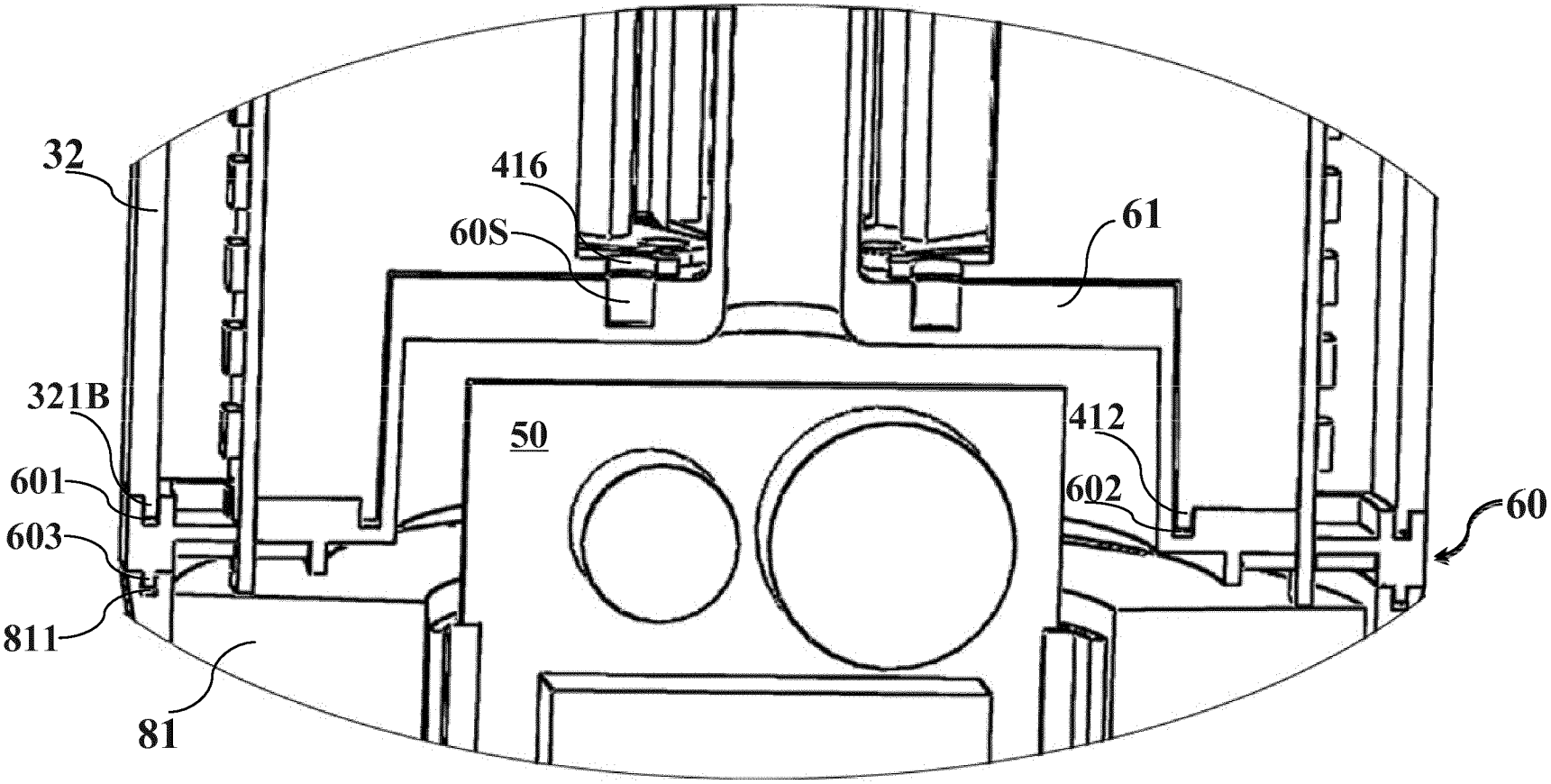
FIG. 6 is an enlarged perspective view of a part, indicated by a circle A, of the lighting device in FIG. 3, showing a part of the side LED light engine, a part of the side light-transmitting cover, a part of the side heat dissipator, a retainer, a part of a driver and a part of a housing.

Particularly, the bottoms of the plurality of side light-transmitting covers 32 are each sealingly connected to a radially outer portion of a top of the retainer 60 in a positive fit manner. Specifically, as shown in FIG. 6, the bottoms of the plurality of side light-transmitting covers 32 each has a convex portion 321B, and the radially outer portion of the top of the retainer 60 has a matched concave portion 601. Or, the bottoms of the plurality of side light-transmitting covers 32 each has a concave portion, and the radially outer portion of the top of the retainer 60 has a matched convex portion (not shown). Similarly, a water-proof glue can be filled in the matched concave portion 601 of the radially outer portion of the top of the retainer 60. Moreover, the convex portion 321B may have a height and a thickness which are respectively slightly smaller than a depth and a width of the concave portion 601, and thus a gap between the convex portion 321B and the concave portion 601 can be sufficiently filled with the water-proof glue, thereby obtaining a better sealing effect.

Furthermore, the bottoms of the side heat dissipators 41 of the plurality of side lighting and heat-dissipating modules LHDM are each sealingly connected to the radially inner portion of the top of the retainer 60 in a positive fit manner. Specifically, as shown in FIG. 6, the bottoms of the side heat dissipators 41 of the plurality of side lighting and heat-dissipating modules LHDM each has a convex portion 412, and the radially inner portion of the top of the retainer 60 has a matched concave portion 602. Or, the bottoms of the side heat dissipators 41 of the plurality of side lighting and heat-dissipating modules LHDM each has a concave portion, and the radially inner portion of the top of the retainer 60 has a matched convex portion (not shown). Similarly, a water-proof glue can be filled in the matched concave portion 602 of the radially inner portion of the top of the retainer 60. Moreover, the convex portion 412 may have a height and a thickness which are respectively slightly smaller than a depth and a width of the concave portion 602, and thus a gap between the convex portion 412 and the concave portion 602 can be sufficiently filled with the water-proof glue, thereby obtaining a better sealing effect. Therefore, with the above convex-concave mating structures of the side lighting and heat-dissipating module and the retainer and in conjunction with the water-proof glue, a better sealing of the side LED light engine is achieved with a simple structure.

Furthermore, the bottom of the retainer 60 is sealingly connected to the housing 80, preferably the top of the first housing 81 (for example, the top periphery), in a positive fit manner, and thus a substantially closed sealing space is formed between the housing 80 and the retainer 60, and the sealing space is then filled with a water-proof (thermal) glue. Specifically, as shown in FIG. 6, the bottom (for example, the bottom periphery) of the retainer 60 has a convex portion 603, preferably an annular convex portion, and the top (for example, the top periphery) of the housing 81 has a matched concave portion 811, preferably an annular concave portion. Or, the bottom (for example, the bottom periphery) of the retainer 60 has a concave portion, preferably an annular concave portion, and the top (for example, the top periphery) of the housing 81 has a matched convex portion, preferably an annular convex portion. Similarly, the matched concave portion 811 of the top of the housing 81 can be filled with a water-proof glue. Furthermore, the convex portion 603 has a height and a thickness which are respectively slightly smaller than a depth and a width of the concave portion 811, and thus the gap between the convex portion 603 and the concave portion 811 can be sufficiently filled with the water-proof glue to obtain a batter sealing effect. Therefore, with the convex-concave mating structures of the retainer and the housing and in conjunction with the water-proof glue, a better sealing of the driver is achieved with a simple structure.

By employing a positive fit, particularly the convex-concave mating structure, at a part of or all of connections between the components of the lighting device 100 and in conjunction with the water-proof glue, the sealing effect of the lighting device is considerably improved, for example a waterproofing and rust-preventing level of IP 65 can be achieved.

Moreover, the first heat-dissipating unit 20 is connected to the tops of the side dissipator 41 of the plurality of side lighting and heat-dissipating modules LHDM via a plurality of, preferably eight, first screws or bolts (not shown), respectively. Preferably, as shown in FIG. 4, each of the first screws or bolts screws through a threaded hole 20S of the first heat-dissipating unit 20 and is threadedly engaged to a threaded hole 414 in the top of the side heat dissipator 44 so as to secure, in a detachable manner, the first heat-dissipating unit 20 and the plurality of side lighting and heat-dissipating modules LHDM together.

Moreover, the side heat dissipators 41 of the plurality of side lighting and heat-dissipating modules LHDM are connected to the top of the retainer 60 via a plurality of, preferably eight, second screws or bolts (not shown), respectively. Specifically, as shown in FIG. 6, each of the second screws or bolts screws through a threaded hole 416 of the side heat dissipator 41 and threadedly engaged to the top of the retainer 60, preferably threadedly engaged to a threaded hole 60S in a boss 61 of the retainer 60, so as to secure, in a detachable manner, the plurality of side lighting and heat-dissipating modules LHDM and the retainer 60 together.

In addition, as shown in FIG. 2, the lighting device 100 may further include an annular printed circuit board (PCB) 70. The annular printed circuit board 70 is arranged between the retainer 60 and the housing 80, preferably the first housing 81. Furthermore, the annular printed circuit board 70 is electrically connected to the driver 50 (via two conductive wires) and is electrically connected to a plurality of, preferably eight, side LED light engines 31 via wirings (not shown) in the retainer 60. By providing the annular printed circuit board, an electrically connecting structure between the driver 50 and the side LED light engine 31 can be simpler.

Furthermore, the driver 50 is connected to the top light engine 11 via wirings in the retainer 60. Specifically, as shown in FIG. 3, the driver 50 is electrically connected to the top light engine 11 via wirings (for example two conductive wires) extending through the boss 61 and a post 62 (for example a hollow post) of the retainer 60, so as to achieve electric connection between the driver 50 and the top light engine 11.

Furthermore, unsealed surfaces of metal components in the lighting device 100 are coated with a water-proof glue to prevent the metal components from exposing to moisture or air through the hole 22 in the first heat-dissipating unit and a gap C between the side lighting and heat-dissipating modules LHDM, thus further prolonging the service life of the heat-dissipating device.

An assembling or producing process of the lighting device 100 according to the present embodiment is now described in conjunction with FIG. 7.

Firstly, as shown in FIG. 7, the first housing 81 is inserted into the second housing 82 to form the housing 80, and optionally, the housing 80 can be integrally formed. Furthermore, prior to or after this step, a base B can be assembled to the second housing 82. Then, as shown in FIG. 8, the driver 50 is inserted into the first housing 81, and preferably, a groove for guiding and retaining the driver 50 is provided in the first housing 81. Next, as shown in FIG. 9, the annular printed circuit board 70 is mounted or glued to the first housing 81 and is potted with a water-proof (thermal) glue to fill a profiled cavity or space of the first housing 81 with the water-proof glue. Then, as shown in FIG. 10, the retainer 60 which preferably has the boss 61 and the post 62 is mounted or glued to the annular printed circuit board 70 and the first housing 81. Next, as shown in FIGS. 11 and 12, a single side LED light engine 31 is fitted or glued to a single side heat dissipator 41, and then a single side light-transmitting cover 32 is fitted to the single side heat dissipator 41 in a positive fit manner, so as to form a single side lighting and heat-dissipating module LHDM. This step is repeated to form a plurality of side lighting and heat-dissipating modules LHDM. Optionally, prior to the preceding steps or during the preceding steps, a step of assembling the plurality of side lighting and heat-dissipating modules LHDM can be performed. Subsequently, as shown in FIG. 13, the assembled plurality of side lighting and heat-dissipating modules LHDM are assembled, in a positive fit manner, to the retainer 60 which has been mounted or glued to the annular printed circuit board 70 and the first housing 81, and optionally, the plurality of side lighting and heat-dissipating modules LHDM are secured to the retainer 60, preferable to the boss 61 of the retainer, by means of a plurality of screws or bolts. Then, as shown in FIG. 14, the first heat-dissipating unit 20 is assembled to the plurality of side lighting and heat-dissipating modules LHDM, and optionally, the first heat-dissipating unit 20 is secured to the plurality of side lighting and heat-dissipating modules LHDM by means of additional plurality of screws or bolts. Subsequently, the top LED light engine 11 is fitted or glued to the first heat-dissipating unit 20 and optionally, the top LED light engine 11 is electrically connected to the driver 50 via the wirings in the boss 61 and the post 62 of the retainer 60. Finally, as shown in FIG. 15, the top light-transmitting cover 12 is mounted or glued to the first heat-dissipating unit 20 in a positive fit manner. So far, the assembly of the lighting device 100 is completed.

By providing a separated side lighting and heat-dissipating module, for example by in advance assembling the side light-transmitting cover, the side LED light engine and the side heat dissipator into a module and the assembling the module to the retainer, the filling of the connecting parts with glue can be made without rotating the whole light, and degree of automation in assembling or manufacturing process can be considerably improved, thus considerably enhancing the productivity.

While preferred embodiments of the present application have been described above in detail, it should be understood that the present application is not limited to the specific embodiments and variations described above, and other variants and modifications can also be achieved by those skilled in the art without departing from the essence and scope of the application, and these variants and modifications should fall into the scope of protection of the application. Moreover, all of the components described herein can be replaced by other technically equivalent substitution.

LIST OF REFERENCE SIGNS lighting device 100
first lighting unit 10
top LED light engine 11
side light-transmitting cover 12
first heat-dissipating unit 20
heat-dissipating fin 21
through hole 22
second lighting unit 30
side LED light engine 31
side light-transmitting cover 32
second heat-dissipating unit 40
side heat dissipator 41
driver 50
retainer 60
boss 61
post 62
annular printed circuit board 70
housing 80
first housing 81
second housing 82
convex portion 121
concave portion 201
side lighting and heat-dissipating module LHDM
gap C
base B
convex portion 321B
convex portion 321S
convex portion 321T
concave portion 411 convex portion 412
concave portion 601
concave portion 602
convex portion 603
concave portion 811
threaded hole 20S
threaded hole 414
threaded hole 416
threaded hole 60S

The invention claimed is:

1. A lighting device, comprising:

a first lighting unit;

a first heat-dissipating unit heat-conductively connected to the first lighting unit;

a second lighting unit;

a second heat-dissipating unit heat-conductively connected to the second lighting unit, wherein the second heat-dissipating unit is detachably connected to the first heat dissipating unit; and a driver electrically connected with the first lighting unit and, separately, with the second lighting unit, wherein the second heat-dissipating unit further comprises a plurality of side heat dissipators, wherein each of the side heat dissipators is detachably connected to the first heat dissipating unit.

2. A lighting device, comprising:

a first lighting unit;

a first heat-dissipating unit heat-conductively connected to the first lighting unit;

a second lighting unit;

a second heat-dissipating unit heat-conductively connected to the second lighting unit, wherein the second heat-dissipating unit is detachably connected to the first heat dissipating unit; and a driver electrically connected with the first lighting unit and, separately with the second lighting unit, wherein the first lighting unit comprises a top LED light engine, the second lighting unit comprises a plurality of side LED light engines, and wherein, the second heat-dissipating unit further comprises a plurality of side heat dissipators corresponding to the plurality of side LED light engines, wherein each of the side heat dissipators is detachably connected to the first heat dissipating unit.

3. The lighting device according to claim 2, wherein the second lighting unit further comprises a plurality of side light-transmitting covers corresponding to the plurality of side LED light engines and the plurality of side heat dissipators, and the plurality of side LED light engines, the plurality of side heat dissipators and the plurality of side light-transmitting covers together constitute a plurality of side lighting and heat-dissipating modules (LHDM), wherein each side lighting and heat-dissipating module (LHDM) consists of one of the plurality of side LED light engines, a respective one of the plurality of side heat dissipators and a respective one of the plurality of side light-transmitting covers.

4. The lighting device according to claim 3, wherein the plurality of side lighting and heat-dissipating modules (LHDM) are circumferentially spaced apart from each other.

5. A lighting device, comprising:

a first lighting unit;

a first heat-dissipating unit heat-conductively connected to the first lighting unit;

a second lighting unit;

a second heat-dissipating unit heat-conductively connected to the second lighting unit, wherein the second heat-dissipating unit is detachably connected to the first heat dissipating unit; and a driver electrically connected with the first lighting unit and, separately with the second lighting unit, wherein the first heat-dissipating unit comprises a circumferential wall, a plurality of heat-dissipating fins distributed on an outer circumferential surface thereof and at least one through hole, each of which being located in the circumferential wall between two adjacent heat-dissipating fins of the plurality of heat-dissipating fins.

6. The lighting device according to claim 5, wherein the first heat-dissipating unit has a truncated dome shape or a truncated cone shape.

7. The lighting device according to claim 2, wherein the first lighting unit further comprises a top light-transmitting cover, the bottom of the top light-transmitting cover is sealingly connected to the top of the first heat-dissipating unit in a positive fit manner, to sealingly retain the top LED light engine within a space between the top light-transmitting cover and the first heat-dissipating unit.

8. The lighting device according to claim 7, wherein the bottom of the top light-transmitting cover has a convex portion and the top of the first heat-dissipating unit has a matched concave portion, or the bottom of the top light-transmitting cover has a concave portion and the top of the first heat-dissipating unit has a matched convex portion.

9. The lighting device according to claim 3, wherein the plurality of side light-transmitting covers have radially inner portions which are sealingly connected to radially outer portions of the plurality of side heat dissipators in a positive fit manner, respectively.

10. The lighting device according to claim 9, wherein the radially inner portions of the plurality of side light-transmitting covers each has convex portions, and the radially outer portions of the plurality of side heat dissipators each has a matched concave portion, or the radially inner portions of the plurality of side light-transmitting covers each has a concave portion, and the radially outer portions of the plurality of side heat dissipators each has a matched convex portion.

11. The lighting device according to claim 3, wherein the lighting device further comprises a retainer and a housing bearing the driver, with the retainer being interposed between the housing and the plurality of side lighting and heat-dissipating modules (LHDM).

12. The lighting device according to claim 11, wherein the bottoms of the plurality of side light-transmitting covers are each sealingly connected to a radially outer portion of the top of the retainer in a positive fit manner.

13. The lighting device according to claim 12, wherein the bottoms of the plurality of side light-transmitting covers each has a convex portion and the radially outer portion of the top of the retainer has a matched concave portion, or the bottoms of the plurality of side light-transmitting covers each has a concave portion and the radially outer portion of the top of the retainer has a matched convex portion.

14. The lighting device according to claim 12, wherein the bottoms of the side heat disspators of the plurality of side lighting and heat-dissipating modules (LHDM) are each sealingly connected to a radially inner portion of the top of the retainer in a positive fit manner.

15. The lighting device according to claim 14, wherein the bottoms of the side heat dissipators of the plurality of side lighting and heat-dissipating modules (LHDM) each has a convex portion and the radially inner portion of the top of the retainer has a matched concave portion, or the bottoms of the side heat dissipators of the plurality of side lighting and heat-dissipating modules (LHDM) each has a concave portion and the radially inner portion of the top of the retainer has a matched convex portion.

16. The lighting device according to claim 11, wherein the bottom of the retainer is sealingly connected to the top of the housing in a positive fit manner.

17. The lighting device according to claim 16, wherein the bottom of the retainer has a convex portion and the top of the housing has a matched concave portion, or the bottom of the retainer has a concave portion and the top of the housing has a matched convex portion.

18. The lighting device according to claim 11, wherein the first heat-dissipating unit is connected to the tops of the side heat dissipators of the plurality of lighting and heat-dissipating modules (LHDM) by means of a plurality of first screws or bolts.

19. The lighting device according to claim 18, wherein the side heat dissipators of the plurality of side lighting and heat-dissipating modules (LHDM) are connected to the top of the retainer by means of a plurality of second screws or bolts.

20. The lighting device according to claim 11, wherein the lighting device further comprises an annular printed circuit board, the printed circuit board is arranged between the retainer and the housing, and wherein, the printed circuit board is electrically connected to the driver and is electrically connected to the plurality of side LED light engines via wirings in the retainer.

21. The lighting device according to claim 11, wherein the driver is electrically connected to the top LED light engine via wirings in the retainer.

22. The lighting device according to claim 8, wherein a water-proof glue is filled between the convex portion and the concave portion.

23. A method of assembling a lighting device, comprising:

inserting a driver into a housing;

mounting an annular printed circuit board to the housing;

mounting a retainer on the annular printed circuit board and the housing in a positive fit manner;

mounting a first lighting unit to the first heat-dissipating unit in a positive fit manner, wherein the first lighting unit comprises a top LED light engine;

connecting a plurality of second lighting units to a plurality of second heat-dissipating units to form a plurality of side lighting modules, wherein the plurality of second lighting units further comprise a plurality of side LED light engines;

mounting, in a positive fit manner, a plurality of side lighting and heat-dissipating modules the plurality of side lighting modules to the retainer which has been mounted on the annular printed circuit board and the housing;

detachably connecting the plurality of second heat-dissipating units to the first heat-dissipating unit.

24. The method of assembling the lighting device according to claim 23, wherein each of the side lighting modules from the plurality of side lighting modules is obtained by the following ways:

fitting or gluing one of the second lighting units to one of the second heat-dissipating units; and mounting one of the second lighting units to one of the second heat-dissipating units in a positive fit manner.

* * * * *